US011473289B2

(12) United States Patent
Cera

(10) Patent No.: US 11,473,289 B2
(45) Date of Patent: Oct. 18, 2022

(54) FRICTION PLATE FOR A TIMBER JOINT

(71) Applicant: Würth International AG, Chur (CH)

(72) Inventor: Udo Cera, Schwäbisch Hall (DE)

(73) Assignee: Würth International AQ, Chur (CH)

( * ) Notice: Subject to any disclaimer, the term of this patent is extended or adjusted under 35 U.S.C. 154(b) by 0 days.

(21) Appl. No.: 16/815,312

(22) Filed: Mar. 11, 2020

(65) Prior Publication Data

US 2020/0291635 A1 Sep. 17, 2020

(30) Foreign Application Priority Data

Mar. 15, 2019 (DE) ..... 102019106602.6

(51) Int. Cl.
*E04B 1/24* (2006.01)

(52) U.S. Cl.
CPC .... *E04B 1/2403* (2013.01); *E04B 2001/2457* (2013.01)

(58) Field of Classification Search
CPC ..... E04B 1/2403; E04B 2001/2457; E04B 1/2608; E04C 3/36
USPC ..... 52/698, 699, 701; 411/460, 466, 468
See application file for complete search history.

(56) References Cited

U.S. PATENT DOCUMENTS 409,546 A * 8/1889 Zeigler ..... E04B 1/49 403/281
1,426,232 A * 8/1922 Theodorsen ..... E04B 1/49 403/283
2,100,415 A * 11/1937 Theodorsen ..... E04B 1/49 411/460
2,990,058 A * 6/1961 Williams ..... B65D 85/48 206/451
3,841,195 A * 10/1974 Jureit ..... F16B 15/0046 411/460
4,157,676 A * 6/1979 Jureit ..... E04B 1/49 411/921
4,209,265 A * 6/1980 Moehlenpah ..... E04B 1/49 403/DIG. 15
4,297,048 A * 10/1981 Jureit ..... F16B 9/052 403/231

(Continued)

FOREIGN PATENT DOCUMENTS

AU 643228 B 11/1993
AU 643228 B2 11/1993

(Continued)

OTHER PUBLICATIONS

Neuger, T.; Search Report in Application No. 10 2019 106 602.6; dated Mar. 23, 2020; pp. 1-8; German Patent and Trademark Office; 80297, Munich, Germany.

(Continued)

*Primary Examiner* — Brian E Glessner
*Assistant Examiner* — Adam G Barlow
(74) *Attorney, Agent, or Firm* — Robert A. Blaha; Smith Tempel Blaha LLC

(57) ABSTRACT

A friction plate for a timber joint between a first connection element of wood and a second connection element, with a plate-shaped carrier with a first carrier connection side for a surface connection to the first connection element and a second carrier connection side for a surface connection to the second connection element, and a roughening of at least one section of the first and/or second carrier connection side.

10 Claims, 7 Drawing Sheets

(56) References Cited

U.S. PATENT DOCUMENTS 4,486,115 A * 12/1984 Rionda ..... F16B 15/0046 403/DIG. 15
4,488,389 A * 12/1984 Farmont ..... E04B 2/702 403/DIG. 15
4,549,838 A * 10/1985 Birckhead ..... B21D 53/38 403/DIG. 15
4,571,114 A * 2/1986 Rionda ..... F16B 15/0046 248/248
4,641,480 A * 2/1987 Mort ..... E04C 3/16 52/693
4,669,235 A * 6/1987 Reinen ..... E04B 1/2608 411/466
4,710,083 A * 12/1987 Wolf ..... E04B 1/49 403/DIG. 15
4,730,971 A * 3/1988 Lin ..... F16B 15/003 52/712
4,734,003 A * 3/1988 Smith ..... F16B 15/0046 403/DIG. 15
4,737,060 A * 4/1988 Birckhead ..... B21D 53/38 403/DIG. 15
4,833,859 A * 5/1989 Wolf ..... E04C 3/18 144/41
4,887,952 A * 12/1989 Wolf ..... F16B 15/0046 411/470
4,891,927 A * 1/1990 Kairi ..... E04B 1/49 52/642
5,006,006 A * 4/1991 Lehtonen ..... F16B 15/0046 403/DIG. 15
5,116,179 A * 5/1992 Matlock ..... F16B 15/0046 411/466
5,531,052 A * 7/1996 Agar ..... E04B 2/7453 52/715
5,551,819 A * 9/1996 Stern ..... E01B 3/06 411/921
5,735,087 A * 4/1998 Olden ..... E04B 1/2608 52/693
5,819,494 A * 10/1998 Haisch ..... E04C 3/11 52/696
5,833,421 A * 11/1998 Lees ..... F16B 15/0046 403/DIG. 15
5,865,586 A * 2/1999 Neville ..... F16B 15/0007 411/460
5,966,892 A * 10/1999 Platt ..... E04B 1/26 52/715
6,171,043 B1 * 1/2001 Williams ..... F16B 15/0046 52/712
6,308,469 B1 * 10/2001 Leung ..... E04B 1/10 52/693
6,412,246 B1 * 7/2002 Tadich ..... E04C 3/17 411/460
7,021,879 B2 * 4/2006 Taneichi ..... F16B 15/0046 403/403
7,083,364 B2 * 8/2006 Kim ..... E02D 29/0225 405/284
7,452,164 B2 * 11/2008 Kim ..... E02D 29/0291 405/262
7,748,190 B1 * 7/2010 Loper ..... F16B 15/0046 52/715
8,225,565 B2 * 7/2012 Cox ..... E04C 2/521 52/404.1
8,371,772 B2 * 2/2013 Chang ..... E02D 29/025 405/18
9,080,325 B1 7/2015 Hensen
9,175,453 B2 * 11/2015 Alfreds ..... E02D 17/202
9,234,350 B1 * 1/2016 Gilbert ..... E04C 3/36
9,512,594 B2 * 12/2016 Callewaert ..... E02D 29/0291
9,528,265 B1 * 12/2016 Gilbert ..... E04C 3/36
9,719,257 B2 * 8/2017 Gilbert ..... E04B 1/2608
10,711,462 B1 * 7/2020 Gilbert ..... E04B 1/2604
2017/0009444 A1 * 1/2017 Downs ..... E04B 1/40

FOREIGN PATENT DOCUMENTS

DE 1 952 529 U 12/1966
JP H0783211 A 3/1995
JP 2001195506 A 10/2001
JP 2002201715 A 7/2002
JP 201257381 A 3/2012
JP 2012057381 A 3/2012
WO 1996024730 A1 8/1996

OTHER PUBLICATIONS

3M Product Data Sheet; 734 Schleifpapier; p. 1; 3M Deutschland GmbH; Carl-Schurz-Strasse 1, 41453, Neuss, Germany.
Extended European Search Report; Application No. 20161366.8; dated Jul. 29, 2020; pp. 1-7; European Patent Office 80298, Munich, Germany.
Delmenico A.; Examination Report No. 2 in Application No. 2020201812; pp. 1-5; dated Feb. 8, 2021; Australian IP Office, P.O. Box 200, Wooden ACT 2606.
Filipovic, L.; Examination Report No. 1; Application No. 2020201812; dated Nov. 20, 2020; pp. 1-8; Auslralian Patent Office; Ground Floor, Discovery House, 47 Bowes Street, Phillip ACT, 2606, Australia.
Delmenico A.; Examination Report No. 4 in Application No. 2020201812; pp. 1-9; dated Aug. 13, 2021; Australian IP Office, P.O. Box 200, Wooden ACT 2606.

* cited by examiner 5
7
9
11
13
1

FIG. 4A
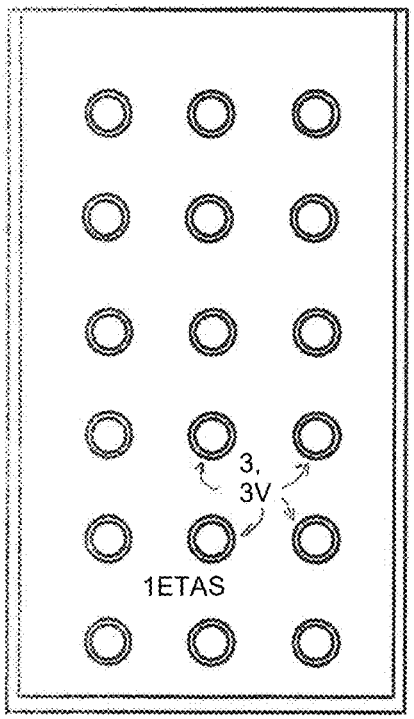
FIG. 4B
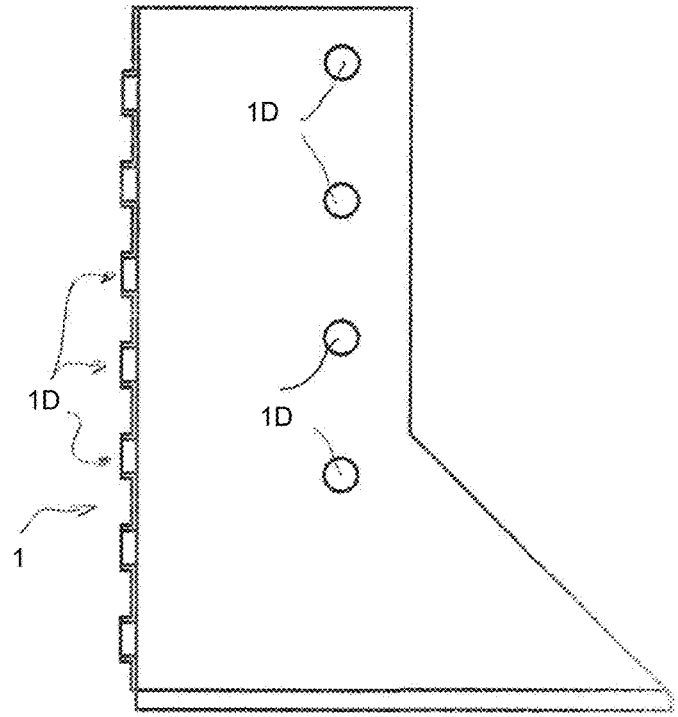
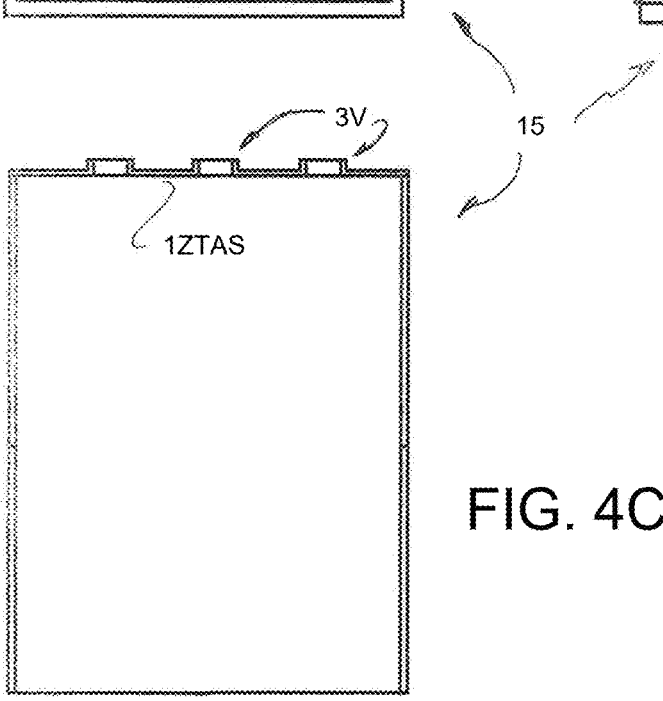
FIG. 4C

FIG. 5B
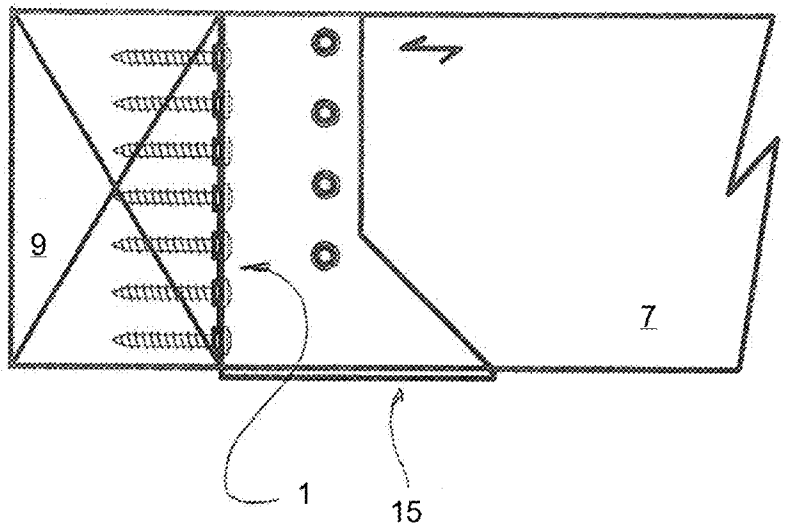
FIG. 5A
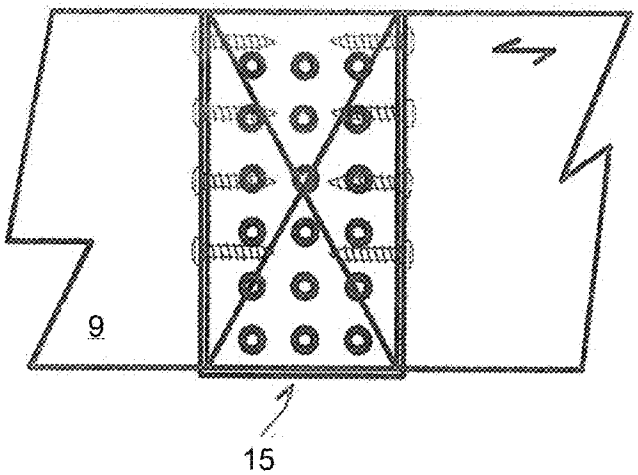
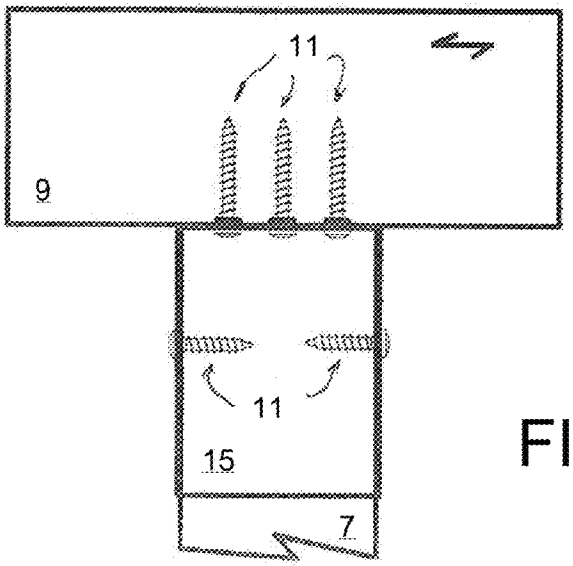
FIG. 5C

FRICTION PLATE FOR A TIMBER JOINT

CROSS-REFERENCE TO RELATED APPLICATION

The present application claims priority to the German Patent Application No. 10 2019 106 602.6 filed Mar. 15, 2019, the disclosure of which is hereby incorporated herein by reference.

TECHNICAL FIELD

Embodiments of the invention relate to a friction plate for a timber joint as well as a timber joint formed with the friction plate.

TECHNOLOGICAL BACKGROUND

It is known to connect wooden beams with butt joints by means of a tension and shear resistant connection. For example, one end of a beam is attached to another beam at a 0 to 90° angle and attached there with screws or other pin-shaped fasteners. The screws can be screwed at an angle by both or a plurality of beams, in particular at a 90° angle from the opposite side of a beam.

Furthermore, it is known to attach wooden beams to a concrete wall or to a metal plate, e.g. a timber connector. For this purpose, screws or pin-shaped fasteners are screwed through the wood and then into the concrete wall or into the metal plate.

The disadvantage of timber joints is always that the loads that can be hold by the connections are too low and higher load capacities or higher stiffnesses are desired.

SUMMARY

Therefore, there may be a need to increase the load capacity and/or the stiffness of timber joints.

This need is met by a friction plate and a timber joint created with the friction plate.

According to an exemplary embodiment of the invention, a friction plate for a timber joint between a first connection element of wood and a second connection element includes a plate-shaped carrier with a first carrier connection side for a surface connection to the first connection element, a second carrier connection side for a surface connection to the second connection element, with a roughening of at least one section of the first and/or second carrier connection side.

According to another exemplary embodiment of the invention, a timber joint between a first connection element made of wood and a second connection element, includes a friction plate with a roughening of at least one section of a first and/or a second surface, the friction plate arranged between the first and the second connection element, and at least one fastening element for holding the friction plate and the first and second connection elements.

OVERVIEW OF EMBODIMENTS

At a connection point, the first and the second connection element abut against each other, wherein the friction plate is arranged between these. Preferably, the connection elements at the connection point abut the friction plate across their entire surface so the connection elements at the connection point lie as extensively as possible on surface of the friction plate. However, it is possible that section of the connection elements are directly adjacent to each other. The timber joint resulting at the connection point between the first connection element, the friction plate and the second connection element is held together by fastening elements, in particular wood screws. The fastening elements thus press the connection elements onto the friction plate with a certain contact pressure. By means of the roughening of the respective carrier connection side of the friction plate, the respective connection element abuts the friction plate with a higher level of stiction than the first connection element made of wood would abut the second connection element in the case of a timber joint without a friction plate. The increased stiction due to the friction plate between the involved elements counteracts a displacement of the elements relative to each other, i.e. the initial displacement of the connection elements relative to each other is made more difficult. A relative displacement of the elements with respect to each other thus occurs only in the case of increased load in comparison to a timber joint without a friction plate. The roughening of the carrier connection sides of the friction plate can be implemented by means of projections or recesses, e.g. by means of milling. It is crucially that only the roughness of the respective carrier connection side is increased, such that the stiction to the connection elements to be connected is increased. This is in contrast to metal plates for timber joints that have the projections, for example in the form of hooks that penetrate into the wood. Precisely this penetration of projections should be avoided in the case of the plate according to embodiments of the invention, however, only the stiction between the connection elements, i.e. the two connection elements and the friction plate, should be increased.

If the load of two identical timber joints are compared (comprising a first connection element made of wood, a second connection element and fastening elements to hold the connection elements to each other), in which a timber joint with and a timber joint without the friction plate is formed between the connection elements, the friction plate—with the same contact pressure due to the fastening elements—ensures a higher level of stiction between the elements and thus a load capacity, because the "slipping" of the elements relative to each other only occurs at higher load capacities.

The carrier of the friction plate can be made of a metal, e.g. aluminum or steel, in particular stainless steel, or plastic, in particular, a glass-fiber reinforced plastic, a laminate, non-woven material or multi-layered paper, for example one-sided or two-sided sanding paper.

If the carrier is made of plastic, laminate, non-woven material or multi-layered paper, it can be introduced into the carrier a roughening, e.g. by embedding small balls in it. For example, small stones, small balls made of a hard plastic, small shards of glass or the like can be embedded into the carrier. It is crucially that these balls are, on the one hand, sufficiently hard so that they are not compressed by the contact pressure and on the other hand, project at a sufficiently low level from the carrier in order to merely increase the stiction to the connection element.

The first connection element can be, for example a wooden beam, especially for roof construction, e.g. a carrier.

The second connection element can be made of wood, in particular a wooden beam, or can consist of steel, for example a steel beam, or a wall section of a building, e.g. consist of masonry or concrete.

The friction plate according to embodiments of the invention is thus suitable for timber joints between a connection element made of wood and another connection element, which can consist of wood, steel, concrete or masonry.

Fastening elements, e.g. screws, hold the first and second connection elements onto each other, between which the friction plate is arranged.

The roughening can be formed on a carrier connection side or both carrier connection sides of the friction plate.

The friction plate has a first carrier connection side to abut against the first connection element and a second carrier connection side to abut against the second connection element. The roughening can be formed on both sides or on one side. In the first case, a roughened carrier connection side abuts against a connection element. In the second case, the friction plate has only one roughened carrier connection side, by means of which it abuts a connection element. In this variant, the opposite and non-roughened carrier connection side is preferably firmly connected to the other connection element. For example, the friction plate with the smooth carrier connection side can be firmly connected to a connection element before joining the timber joint, for example being screwed there, so that a slipping of the friction plate relative to this connection element is prevented.

This variant is particularly preferred in applications where a metal component is firmly connected to a connection element, for example a joist hanger being firmly connected to a connection element, for example being screwed to it. An outer side of the joist hanger, which is then provided for the installation on the other connection element to form the timber joint, has the roughening in order to increase the increased stiction between the joist hanger and the connection element which abuts against it. The joist hanger is already firmly connected to the other connection element, for example being screwed on.

The roughening is advantageously formed in at least one section of the respective carrier connection side and preferably takes up the entire carrier connection side. However, for the formation of the timber joint it is sufficient if the roughening is formed in the section of the carrier connection side, by means of which the friction plate abuts the respective connection element, but preferably at least half of this surface is roughened in order to achieve a higher stiction and thus a higher load capacity.

The roughening is formed in at least one section in a first variant by means of projections, for example being ring-shaped or pyramidal or conical, wherein these are preferably arranged in a matrix-like manner.

In a second variant the roughening is formed in at least one section by means of milling, e.g. in a line-shaped manner.

The different types of roughing, e.g. projections and milling cuts, can occur separately or in a mixed form. For example, in one section of a carrier connection side, only projections can be formed and, in another section, only milling cuts can be formed. However, projections and milling cuts can also be formed in a section of a carrier connection side.

If the friction plate has pre-punched holes for feeding through fastening elements, the burr formed during punching preferably suffices as a roughening. Alternatively, the roughening, for example, line-shaped recesses, can already be introduced when rolling the sheet for the production of the friction plate. On a smooth carrier of a friction plate, elements forming a roughening can also be permanently applied. For example, thereby, a sanding paper can be glued to one side of a carrier of the friction plate to form the roughening. Fabrics can also be permanently glued on a carrier connection side of a carrier in order to form the roughening.

The carrier preferably has a thickness of 0.2 to 12 mm, in particular, from 0.5 to 4 mm. The roughening of the respective carrier connection side, for example in the form of projections or milled lines, has a height or depth of 0.1 to 3 mm, in particular from 0.5 to 1.5 mm with relation to the surface of the respective carrier connection side.

Since the roughening therefore projects only slightly from the surface of the respective carrier connection side, when applying the roughening to the connection element, only the stiction is increased. When creating the timber joint, in particular when tightening the fastening elements, no force is used in order to press the roughening into the wood.

Favorably, the friction plate has at least one through hole to guide a fastening element, in particular a wood screw, through this when forming the timber joint.

In addition or as an alternative, the friction plate can also be pierced by a wood screw without pre-drilling, in particular a self-drilling wood screw. In order to allow the friction plate to be pierced by a wood screw without pre-drilling, many parameters can be suitably selected: For example, the material that is made up of the carrier of the friction plate can be suitably selected. This is where plastics or soft metals, such as aluminum, can be used. In addition or as an alternative, the thickness of the carrier can be suitably chosen so that it can be easily pierced, for example the thickness of the carrier being smaller than 3 mm.

The at least one fastening element is favorably formed by screws, in particular wood screws, being furthermore preferred self-drilling wood screws and/or drill rod dowels, in particular self-drilling drill rod dowels.

BRIEF DESCRIPTION OF THE DRAWINGS

Further features, details and advantages of the invention result from the claims and the following description of preferred embodiments, as well as on the basis of the drawing. The figures show:

FIG. 4A is a first lateral view; FIG. 4B is a second lateral view and FIG. 4C is a top view of a joist hanger with a friction plate according to an embodiment of the invention in a further embodiment, FIG. 5A is a first cross-sectional view; FIG. 5B is a lateral view and FIG. 5C is a top view of a timber joint with the joist hanger in FIGS. 4A, 4B and 4C.

DETAILED DESCRIPTION OF EXEMPLARY EMBODIMENTS

Figure 1B:
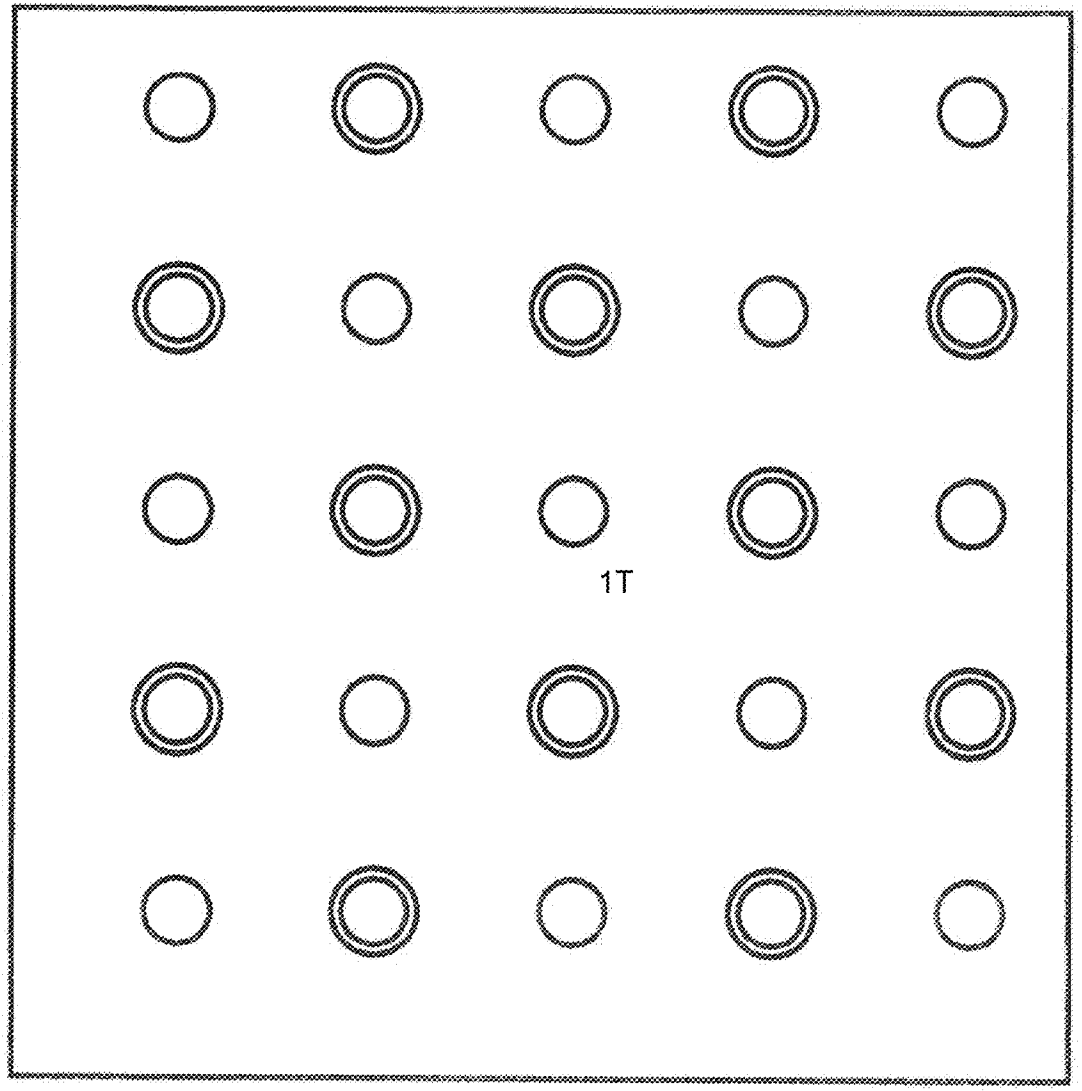
FIG. 1A is a cross-sectional and FIG. 1B is a top view of a friction plate according to an embodiment of the invention.

The illustrations in the drawings are schematically presented. In different drawings, similar or identical elements are provided with the same reference signs.

Figure 1A:
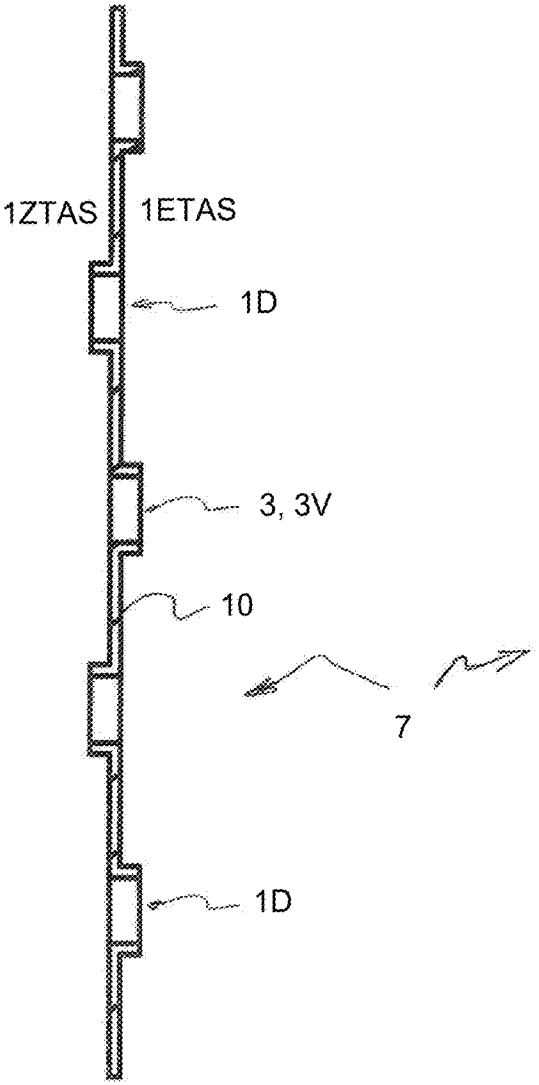

FIG. 1A shows a cross-sectional view and FIG. 1B shows a top view of a friction plate 1 according to a first embodiment with a carrier 1T and a roughening 3 in the form of projections 3V. The friction plate 1 has two opposite lateral surfaces as first and second carrier connection side 1ETAS, 1ZTAS for connecting to a respective connection element 7, 9 (not shown in FIG. 1A or FIG. 1B).

The friction plate 1 is made of stainless steel and has through holes 1D for feeding through fastening elements 11 (not shown in FIG. 1A or FIG. 1B), wherein the through holes were punched into the friction plate 1. The through holes 1D were punched into the friction plate 1 in such a way that each through hole has a ring-shaped collar as a projection 3V. The projections 3V form the roughening 3 of the respective carrier connection side 1ETAS, 1ZTAS. The through holes 1D and thus the protrusions 3V are arranged matrix-like, wherein the projections 3V project from both carrier connection sides 1ETAS, 1ZTAS in an alternating manner.

The carrier 1T of the friction plate 1 has a thickness of 0.8 mm. The projections 3V project by 0.25 mm with relation to the surface 1O of the respective carrier connection sides 1ETAS, 1ZTAS.

Figures 2A, 2B, 2C:
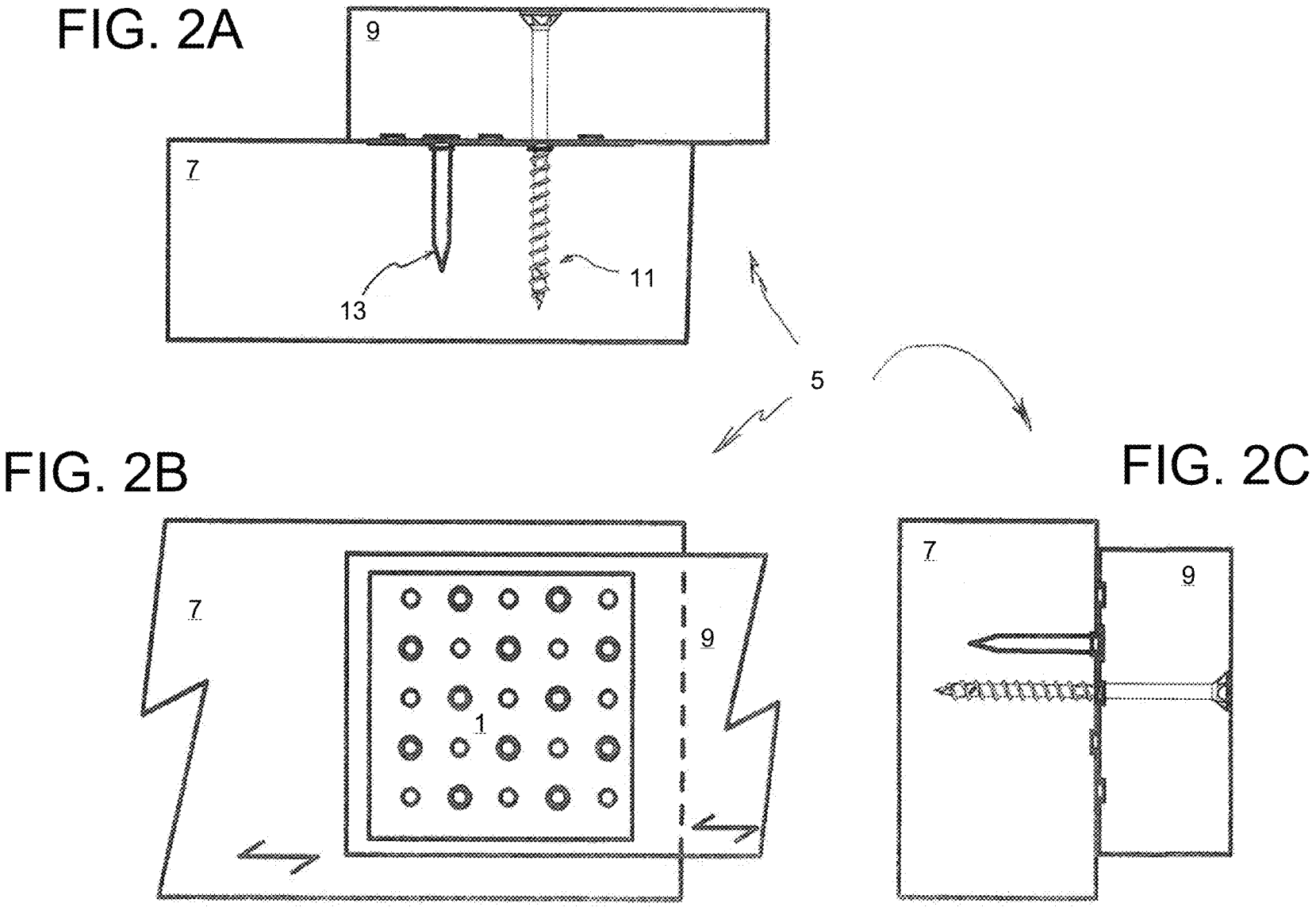
FIG. 2A is a top view.
FIG. 2B is a lateral view and FIG. 2C is a cross-sectional view of a shear connection with the friction plate of FIG. 1A and FIG. 1B.

FIGS. 2A, 2B and 2C show a timber joint 5 with a first and a second connection element 7, 9 wherein the friction plate 1 in FIGS. 1A and 1B is arranged between these. The first and second connection elements 7, 9 are each a wooden beam. The two connection elements 7, 9 extensively abut the surface of each other in the area of one of their respective ends on each other. As can be taken in particular from FIG. 2B, the connection elements abut against each other with a surface greater than the friction plate 1. As shown in FIGS. 2A and 2B, the friction plate 1 is fastened to the connection element 7 with a nail 13 and a wood screw 11 is screwed through the other connection element 9 and screwed through a through hole 1D in the friction plate 1 into the connection element 7. The wood screw 11 is a self-drilling wood screw and is flush sunk in the connection element 9. A thread of the wood screw 11 is completely arranged in the connection element 7 and a threadless shaft is completely arranged in the connection element 9 so that a head of the wood screw 9 presses the connection element 9 against the connection element 7. In FIGS. 2A, 2B and 2C, only a wood screw 11 is shown that presses the connection elements 7, 9 against each other. Other wood screws 11 can be screwed through the connection elements 7, 9 and the friction plate 1 to hold them together depending on the application or the load capacities.

Figure 3A:
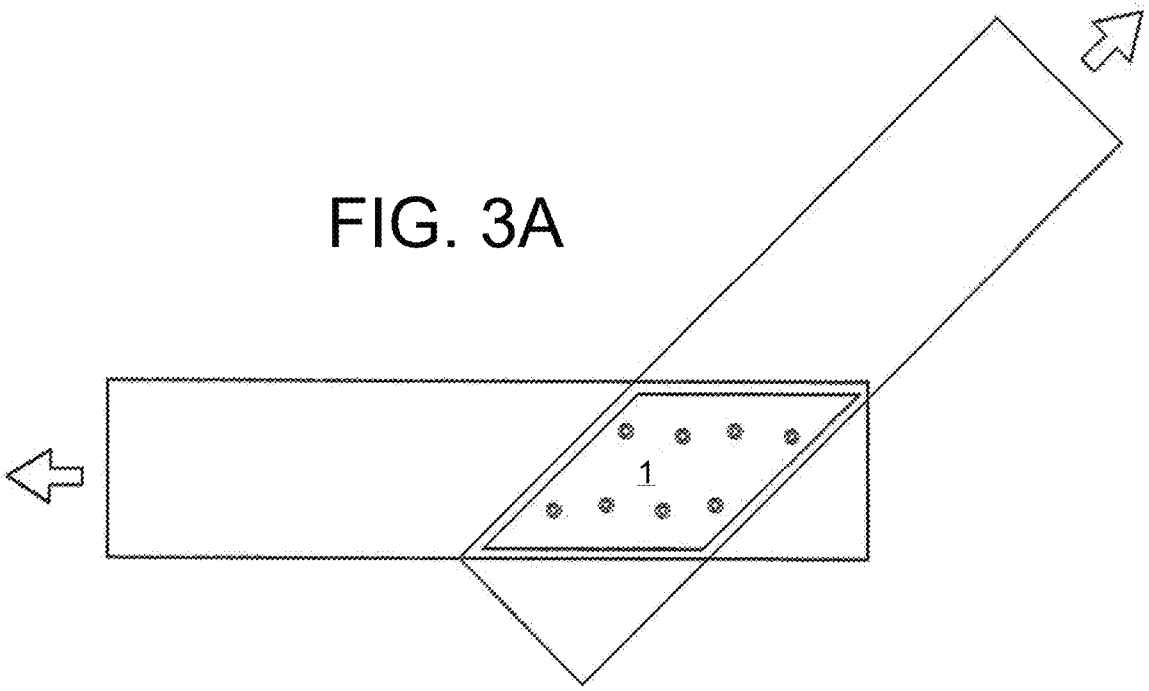
FIG. 3A is a top view and FIG. 3B is a cross-sectional side view and FIG. 3C is a separate side view of an assembly with a friction plate like in FIGS. 1A and 1B, but with a different base area.
Figure 3B:
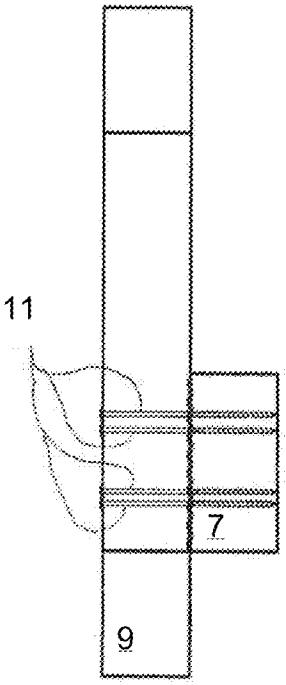
Figure 3C:
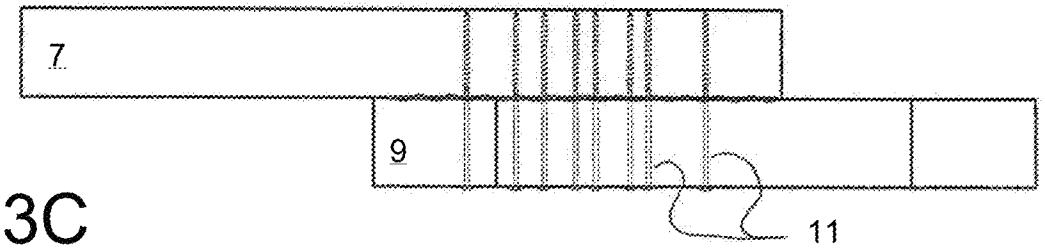

FIGS. 3A, 3B and 3C show a timber joint 5 between two wooden beams as connection elements 7, 9, between which a friction plate 1 is arranged. While the connection element 7, 9 in FIGS. 2A, 2B and 2C run parallel to each other, the connection elements 7, 9 in FIGS. 3A, 3B and 3C form an approximately 135° angle to each other. The friction plate 1 in FIGS. 3A, 3B and 3C is analogous to the friction plate 1 in FIGS. 1A and 1B but has a trapezoidal base area instead of a square one. As it is shown in FIG. 1A and FIGS. 2A and 2C, the through holes 1D forming the projections 3V are arranged in two rows, through which wood screws 11 are screwed, as it is shown in particular by FIGS. 3B and 3C. As it is described regarding FIG. 2A, the thread of the wood screws 11 is completely arranged in a connection element 7 and the threadless shaft of the wood screws is completely arranged in the other connection element 9, wherein again, the friction plate 1 is arranged between these and the wood screws are screwed through the through holes 1D.

FIGS. 4A, 4B and 4C show in three views a joist hanger 15 made of steel. As can be seen in particular from FIGS. 4B and 4C, in one side of the joist hanger 15 through holes 1D are arranged matrix-like, which form projections 3V as described above. FIG. 4B shows four through holes 1D in two opposite sides of the joist hanger 15, which do not form projections 3V.

FIGS. 5A, 5B and 5C show the joist hanger 15 of FIGS. 4A, 4B and 4C, wherein a first connection element 7 in the form of a wooden beam is inserted into the joist hanger 15 in order to connect this at a 90° angle to another connection element 9 in the form of a wooden beam. The connection element 7 is fixed in the joist hanger 15 by the wood screws 11 being screwed through the through holes 1D of the opposite sides of the joist hanger 15, which do not form projections 3V; see FIG. 5C in particular. Through the through holes 1D of the joist hanger 15, which form projections 3V, wood screws 11 are screwed into the further connection element 9. The side surface of the joist hanger 15 with projections 3V, which side surface abuts against the connection element 9, forms a friction plate 1. The friction plate 1 differs from the above among other in that on the one hand the roughening 3 is formed only on one carrier connection side 1ETAS (and the other carrier connection side 1ZTAS has no roughening 3) and on the other hand the friction plate 1 is an integral part of another component, hereinafter forms a part or section of the joist hanger 15.

Figure 6B:
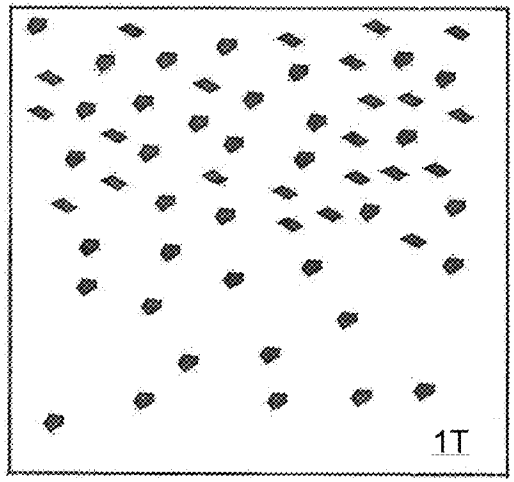
FIG. 6A is a cross-sectional view and FIG. 6B is a top view of a friction plate according to a further embodiment of the invention.
Figure 6A:
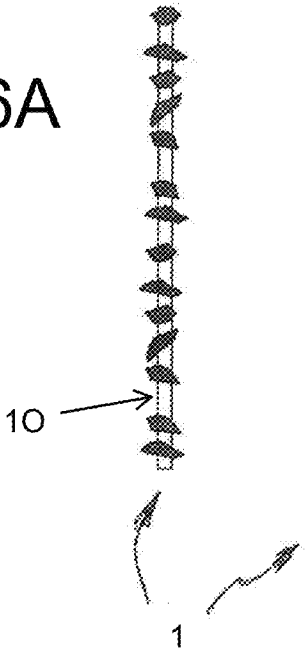

FIGS. 6A and 6B show a further embodiment of the friction plate 1 according to an embodiment of the invention. In the present case, the friction plate 1 has a carrier 1T made of plastic. When casting the carrier 1T, small stones 17 were poured in, so that the stones 17 are enclosed by the plastic and held by it. Stones 17 are irregularly poured into the carrier 1T, as shown in particular in FIG. 6B.

The plastic from which the carrier 1T is cast is a hard plastic so that the carrier 1T is rigid. However, it is also possible to use a soft plastic so that the carrier 1T can be rolled up. In this variant, the friction plate 1 can be present in the form of a roll from which required pieces can be separated in the desired size.

The carrier 1T of the friction plate 1 has a thickness of 1.5 mm. The stones have a maximum size of 2.5 mm so that they protrude not more than 1 mm from a surface 1O of the carrier.

Figure 7:
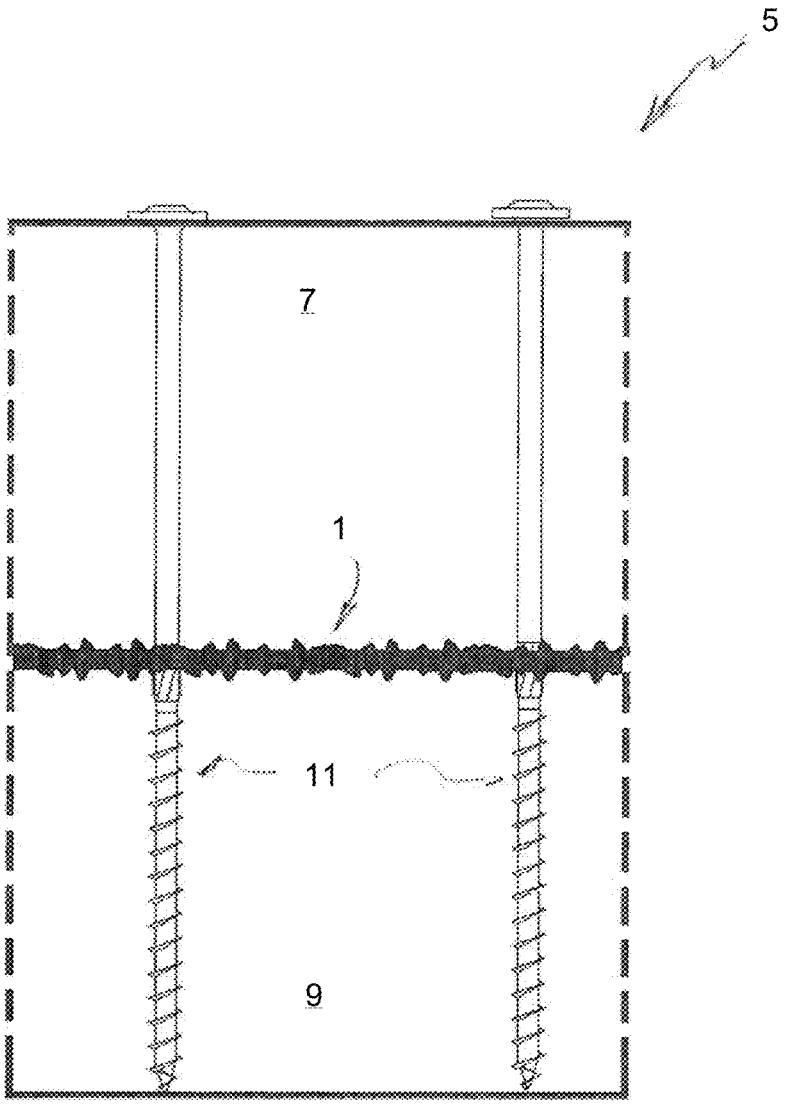
FIG. 7 illustrates the friction plate in FIGS. 6A and 6B between two wooden connection elements to form a timber joint.

FIG. 7 shows a timber joint 5 between two connection elements 7, 9 (each a wooden beam), wherein the friction plate 1 in FIGS. 6A and 6B is arranged between these. For the creation of the timber joint 5, the wooden beams 7, 9 were laid onto one another and the friction plate 1 were arranged between these. Subsequently, wood screws 11 were drilled through the connection element 7 and the friction plate 1 into the connection element 9. Pre-drilling of the connection elements 7, 9 or the friction plate 1 is not necessary since the wood screws are 11 self-drilling. The wood screws can easily penetrate the friction plate 1 since the friction plate 1 is, on the one hand, made of plastic and, on the other hand, comprises only a low level of thickness.

The friction plate 1 is described in the above described embodiments so that a plurality of fastening elements 11 can be guided through these. However, it is possible to manufacture the friction plate 1 to be circular, for example with a diameter of smaller than 15 cm, more preferably smaller than 10 cm, or to be square, for example with an edge length of less than 15 cm, more preferably shorter than 10 cm. In this embodiment, friction plates 1 can be arranged at selected points of a timber joint 5 and respectively one fastening element 11 can be guided through these in order to increase the stiction only at these select points. Between the two connection elements 7, 9 one or a plurality of such friction plates 1 can be arranged, wherein possibly one or a plurality of friction plates 1 of the previously described embodiments in accordance with FIGS. 1A, 1B, 2A, 2B, 2C, 3A, 3B, 3C, 4A, 4B, 4C, 5A, 5B, 5C, 6A, 6B to 7 can additionally be used.

Thus, a plurality of equal or also a plurality of different friction plates 1 between the connection elements 7, 9 can be arranged to form the timber joint 5.

Supplementarily, it should be noted that "comprising" does not exclude other elements or steps and the article "a" or "an" does not exclude a plurality. Furthermore, it is noted that features or steps, which are described with reference to one of the above embodiments, can also be used in combination with other features or steps of other examples described above.

REFERENCE SIGNS

1 friction plate
1D through hole
1T carrier
1ETAS first carrier connection side
1O surface of the carrier
1ZTAS second carrier connection side
3 roughening
3V projection
5 timber joint
7 first connection element made of wood
9 second connection element
11 fastening element
13 nail
15 joist hanger
17 stone

The invention claimed is:

1. A friction plate for a timber joint between a first connection element of wood and a second connection element, comprising:

a plate-shaped carrier with a first carrier connection side for a surface connection to the first connection element, a second carrier connection side for a surface connection to the second connection element, and a roughening of at least one section of the first and/or second carrier connection side, wherein the roughening is formed in at least one section by pyramidal projections, wherein the roughening comprises a height of 0.1 to 3 mm with relation to the surface of the respective carrier connection side, wherein the friction plate can be pierced by a wood screw without pre-drilling.

2. The friction plate according to claim 1, wherein the carrier is made of a metal or plastic, a laminate, non-woven material or multi-layered paper.

3. The friction plate according to claim 1, wherein the first connection element is a wooden beam.

4. The friction plate according to claim 1, wherein the second connection element is made of wood or is made of steel, or a wall section of a building.

5. The friction plate according to claim 1, wherein the roughening is formed on a carrier connection side or both carrier connection sides.

6. The friction plate according to claim 1, wherein the roughening is formed in at least one section of the respective carrier connection side or comprises a roughening in the section of the carrier connection side, by which it abuts the connection element.

7. The friction plate according to claim 1, wherein the carrier comprises a thickness of 0.2 to 12 mm.

8. The friction plate according to claim 1, wherein at least one through hole in order to guide a fastening element through this when forming the timber joint.

9. A timber joint between a first connection element made of wood and a second connection element, comprising:

a friction plate between the first and the second connection element, the friction plate having a surface roughened in at least one section by pyramidal projections comprising a height of 0.1 to 3 mm with relation to the surface of the respective carrier connection side, wherein the friction plate can be pierced by a wood screw without pre-drilling; and at least one fastening element for holding the friction plate and the first and second connection elements at each other.

10. The timber joint according claim 9, wherein the at least one fastening element is formed by screws and/or drill rod dowels.

* * * * *